US005645497A

United States Patent [19]

Sullivan et al.

[11] Patent Number: 5,645,497

[45] Date of Patent: Jul. 8, 1997

[54] GOLF BALL

[75] Inventors: Michael J. Sullivan, Chicopee; R. Dennis Nesbitt, Westfield, both of Mass.

[73] Assignee: Lisco, Inc., Tampa, Fla.

[21] Appl. No.: 538,340

[22] Filed: Oct. 3, 1995

[51] Int. Cl.[6] ..... A63B 37/06; A63B 37/12

[52] U.S. Cl. ..... 473/377; 473/372; 473/351

[58] Field of Search ..... 473/377, 372, 473/351; 273/228

[56] References Cited

U.S. PATENT DOCUMENTS 5,368,304 11/1994 Sullivan et al. ..... 473/377

*Primary Examiner*—George J. Marlo
*Attorney, Agent, or Firm*—Laubscher & Laubscher

[57] ABSTRACT

A golf ball comprising a molded core and a cover about the core. The core and cover have a combined weight of between 47 grams and 53 grams, a coefficient of restitution of at least substantially 0.800, and a Riehle compression between 0,037 inch and 0.045 inch.. The outside diameter of the ball is at least substantially 1.62 inches and less than 1.68 inches.

7 Claims, 1 Drawing Sheet

GOLF BALL

The present invention relates broadly to golf balls and more particularly to a golf ball which is manufactured with the intent of exceeding distance standards set forth by the U.S.G.A.

The bulk of golf balls manufactured today adhere strictly to U.S.G.A. standards, which are designed to control the manufacture of golf balls used in any U.S.G.A. sanctioned functions. Most manufacturers adhere to these standards since the vast majority of people obviously use golf balls which meet these U.S.G.A. standards. There is a market for balls manufactured strictly on the basis of increasing distance, however, and such balls are advertised extensively and purchased by a fairly large number of golfers.

Accordingly, it is an object of the present invention to provide a golf ball having exceptionally high coefficient of restitution and other characteristics which result in a ball that exceeds the U.S.G.A. overall distance standards.

Such a ball combines the use of a heavy core and a relatively hard cover with an outside diameter no greater than 1.68 inches and preferably substantially less than 1.68 inches.

These and other objects of the invention will become apparent from the following description.

SUMMARY OF THE INVENTION

The present invention provides a golf ball having a molded core and a cover about the core. The core and cover have a combined weight of between 47–52 grams and the ball, consisting of the core and cover, has a coefficient of restitution of at least 0.800. The ball may have an outside diameter as low as 1.62 inches.

BRIEF DESCRIPTION OF THE DRAWING

The single FIGURE of drawing is a partial sectional view of the ball of the present invention.

DETAILED DESCRIPTION OF THE PREFERRED EMBODIMENTS

Figure 1:
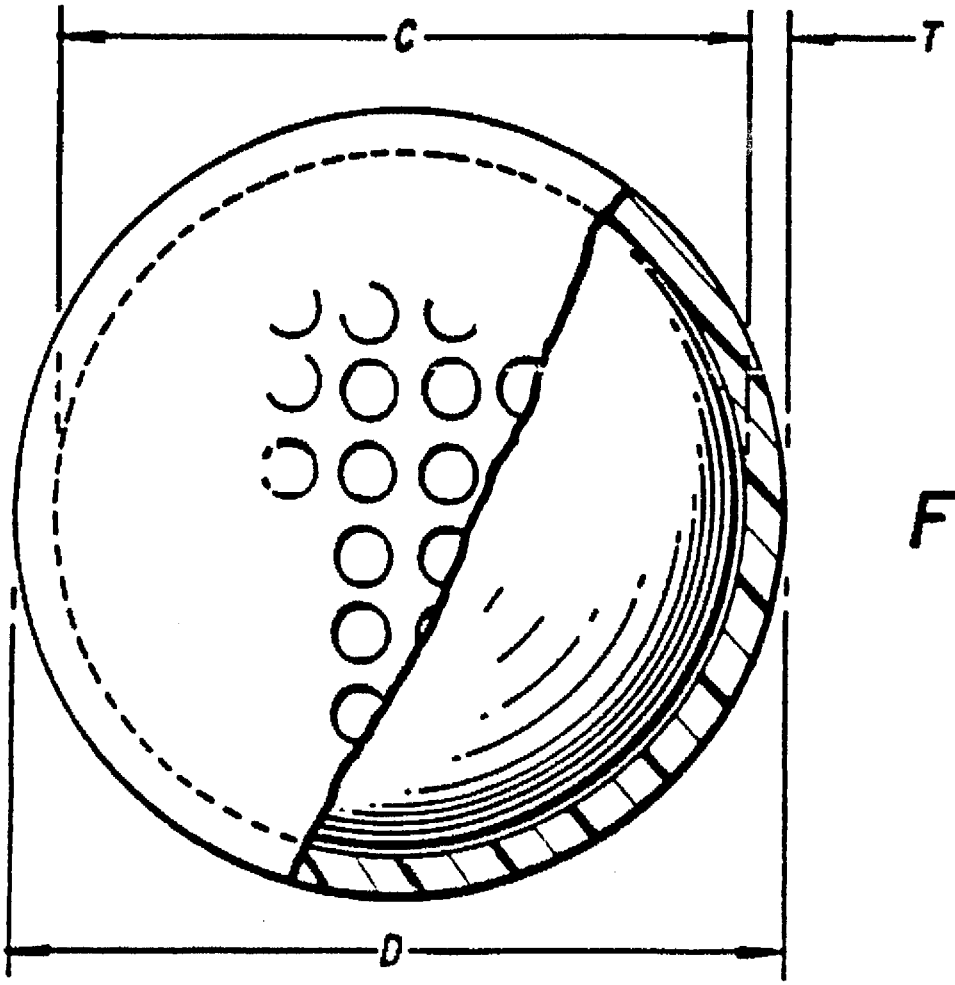

The basic design of the golf ball of the present invention provides a ball which is heavier than 1.62 ounces and no larger in diameter than 1.68 inches. This ball is faster in initial velocity, longer in overall distance, and heavier than allowed by current U.S.G.A. rules.

The following description relates to the general showing of a two piece golf ball as shown in the drawing. The ball has an outside diameter D, a core diameter C and a cover thickness T. Thus, the outside diameter D of the finished ball is equal to C+2 T.

Three balls having the compositions set forth below were manufactured. These balls were used in comparison tests with existing golf balls, which test results also are set forth below. The golf balls are numbered 1, 2, and 3 and will be referred to in that manner in the subsequent discussion and test results.

| CORE COMPOSITION | BALL 1 | BALL 2 | BALL 3 |
|---|---|---|---|
| Polybutadiene | 100.0 | 100.0 | 100.0 |
| ZnO | 10.0 | 10.0 | 60.0 |
| Zinc Diacrylate | 50.0 | 50.0 | 50.0 |
| Stearic Acid | 1.0 | 1.0 | 1.0 |
| Tungsten Powder | 65.0 | 52.0 | 0.0 |
| Peroxide | 1.5 | 1.5 | 1.0 |
| TOTALS | 227.5 | 214.5 | 212.0 |

COVER

The cover is a blend of two or more ionomer resins, each ionomer resin comprising from about 15% to about 25% by weight of carboxylic acid.

| FINISHED BALL | BALL 1 | BALL 2 | BALL 3 |
|---|---|---|---|
| Diameter (Inches) | 1.621 | 1.621 | 1.621 |
| Weight (Grams) | 52.900 | 50.600 | 48.200 |
| Riehle Compression (Inches) | 0.045 | 0.045 | 0.037 |
| Coefficient of Restitution | 0.802 | 0.810 | 0.808 |
| Shore D Cover Hardness | 69 | 69 | 69 |

As will be noted, the finished balls all have a diameter of substantially 1.62 inches while the weight varies between 48.2 and 52.9 grams. The Riehle compression in inches varies between 0.037 and 0.045 and the coefficient of restitution varies between 0.802 and 0.808.

Riehle compression is a measurement of the deformation of a golf ball in inches under a fixed static load of 200 pounds.

Coefficient of restitution (C.O.R.) was measured by firing the resulting golf ball from an air cannon at a forward velocity of 125 feet per second (±5 feet per second) against a steel plate positioned 12 feet from the muzzle of the cannon. The rebound velocity was then measured and divided by the forward velocity to give the coefficient of restitution.

For comparison purposes, the following additional balls were used in distance tests set forth below:

| BALL | WEIGHT (Grams) | RIEHLE COMPRESSION (Inches) | C.O.R. | DIAMETER (inches) | SHORE D COVER HARDNESS |
|---|---|---|---|---|---|
| PINNACLE DISTANCE | 45.7 | 0.046 | 0.817 | 1.683 | 66 |
| BANDIT | 47.3 | 0.032 | 0.784 | 1.645 | 66 |
| LONGBALL | 47.1 | 0.037 | 0.760 | 1.644 | 66 |

It is noted that the PINNACLE DISTANCE ball is U.S.G.A. approved, while the BANDIT and LONGBALL balls are not.

Balls 1, 2, 3 and the PINNACLE DISTANCE, BANDIT, and LONGBALL balls, discussed above, all were used in the four tests for distance set forth below. All of these balls have an estimated dimple coverage of between 70% and 80% of the surface of the ball.

TEST #1
TOP-FLITE DRIVER, CLUB HEAD SPEED 145
Launch Angle (degrees): 8.6
Ball Speed (fps): 194

| BALL TYPE | BALL 1 | BALL 2 | BALL 3 | PINNACLE DISTANCE | BANDIT | LONGBALL |
|---|---|---|---|---|---|---|
| TRAJECTORY | 8.5 | 9.4 | 10.1 | 10.1 | 10.4 | 9.3 |
| FLIGHT TIME | 5.4 | 5.6 | 5.7 | 5.7 | 5.7 | 5.4 |
| CARRY | 215.7 | 219.3 | 218.5 | 210.9 | 211.5 | 209.0 |
| ROLL | 24.3 | 20.3 | 29.1 | 18.4 | 18.3 | 19.7 |
| TOTAL DISTANCE | 240.0 | 239.5 | 238.4 | 229.3 | 229.8 | 228.7 |

TEST #2
TOP-FLITE DRIVER, CLUB HEAD SPEED 160
Launch Angle (Degrees): 8.6
Ball Speed (fps): 229

| BALL TYPE | BALL 1 | BALL 2 | BALL 3 | PINNACLE DISTANCE | BANDIT | LONGBALL |
|---|---|---|---|---|---|---|
| TRAJECTORY | 9.4 | 10.2 | 11.1 | 10.7 | 11.3 | 10.2 |
| FLIGHT TIME | 6.1 | 6.4 | 6.6 | 6.4 | 6.3 | 6.2 |
| CARRY | 263.4 | 266.6 | 266.0 | 250.5 | 257.9 | 251.6 |
| ROLL | 18.5 | 13.3 | 14.6 | 15.4 | 17.6 | 19.3 |
| TOTAL DISTANCE | 281.9 | 280.1 | 280.6 | 265.9 | 275.5 | 270.8 |

TEST #3
TOP-FLITE 3-WOOD, CLUB HEAD SPEED 145
Launch Angle (Degrees): 9.4
Ball Speed (fps): 197

| BALL TYPE | BALL 1 | BALL 2 | BALL 3 | PINNACLE DISTANCE | BANDIT | LONGBALL |
|---|---|---|---|---|---|---|
| TRAJECTORY | 11.0 | 11.5 | 12.4 | 13.1 | 12.5 | 11.5 |
| FLIGHT TIME | 5.9 | 6.2 | 6.2 | 6.3 | 6.1 | 6.0 |
| CARRY | 224.3 | 225.8 | 223.3 | 217.3 | 216.1 | 215.2 |
| ROLL | 10.5 | 9.0 | 7.8 | 9.5 | 9.4 | 9.8 |
| TOTAL DISTANCE | 235.0 | 234.8 | 230.7 | 226.8 | 225.5 | 224.9 |

TEST #4
TOP-FLITE 3-WOOD, CLUB HEAD SPEED 160
Launch Angle (degrees): 9.6
Ball Speed (fps): 226

| BALL TYPE | BALL 1 | BALL 2 | BALL 3 | PINNACLE DISTANCE | BANDIT | LONGBALL |
|---|---|---|---|---|---|---|
| TRAJECTORY | 12.4 | 13.0 | 13.4 | 15.3 | 13.8 | 12.6 |
| FLIGHT TIME | 6.1 | 6.6 | 6.9 | 6.4 | 6.4 | 6.4 |
| CARRY | 273.4 | 276.1 | 275.4 | 265.6 | 264.3 | 262.3 |
| ROLL | 8.2 | 5.4 | 6.4 | 8.0 | 9.5 | 13.3 |
| TOTAL DISTANCE | 281.6 | 281.5 | 281.8 | 273.6 | 273.7 | 275.5 |

As can be seen from the above tests, balls 1, 2, and 3 all had a carry distance substantially greater than the three other balls as well as a total distance substantially greater than the three other balls. Ball 1, which is the heaviest ball (as set forth in the ball statistics above), provided the greatest total distance in all of the tests.

The ball of the present invention, having the characteristics discussed above, exceeds the U.S.G.A. standards relative to distance, and also exceeds the total distance of those balls on the market which are advertised as extra long distance balls which do not meet U.S.G.A. standards.

The above description and discussion of the golf ball of the present invention is illustrative only since the specifics of the composition may be varied and still remain within the desired parameters of the ball characteristics set forth. Accordingly, the present invention is to be limited only by the scope of the following claims.

We claim:

1. A golf ball comprising a solid non-wound core; and a cover about said core;

said core and cover having a combined weight of between 47 grams and 53 grams and said core and cover having a combined coefficient of restitution of at least substantially 0.800; and said ball having an outside diameter substantially less than 1.68 inches.

2. The golf ball of claim 1 wherein the outside diameter of said ball is between 1.62 inches and substantially less than 1.68 inches.

3. The golf ball of claim 1 wherein the outside diameter of the ball is substantially 1.62 inches.

4. The golf ball of claim 1 wherein said core and said cover have a combined Riehle compression of between 0.037 inch and 0.045 inch.

5. The golf ball of claim 1 wherein the weight of said ball is substantially greater than 47 grams.

6. The golf ball of claim 1 wherein the weight of said ball is substantially 50 grams.

7. The golf ball of claim 1 wherein the weight of said ball is substantially 53 grams.

* * * * *